US006481164B1

(12) United States Patent
McCorkel

(10) Patent No.: US 6,481,164 B1
(45) Date of Patent: Nov. 19, 2002

(54) RAINWATER DIVERTER

(76) Inventor: Joseph McCorkel, 1405 Zimmerman Rd., Carlisle, PA (US) 17013

( * ) Notice: Subject to any disclaimer, the term of this patent is extended or adjusted under 35 U.S.C. 154(b) by 0 days.

(21) Appl. No.: 09/670,247

(22) Filed: Sep. 26, 2000

Related U.S. Application Data

(60) Provisional application No. 60/196,701, filed on Apr. 13, 2000.

(51) Int. Cl.[7] ..... E04D 1/36
(52) U.S. Cl. ..... 52/58; 52/16; 52/302.6
(58) Field of Search ..... 52/12, 97, 58

(56) References Cited

U.S. PATENT DOCUMENTS

| | | | | |
|---|---|---|---|---|
| 600,062 A | * | 3/1898 | Caragher | |
| 3,241,271 A | | 3/1966 | Berg | |
| 4,389,824 A | | 6/1983 | Anderson | |
| 5,022,204 A | | 6/1991 | Anderson | |
| 5,109,641 A | | 5/1992 | Halan | |
| 5,333,419 A | | 8/1994 | Hickner | |
| 5,519,969 A | | 5/1996 | Golba | |
| 5,675,939 A | | 10/1997 | Hickner | |
| 5,799,445 A | * | 9/1998 | Kock | 52/16 |
| 5,875,590 A | * | 3/1999 | Udelle | 52/16 |
| 6,009,672 A | | 1/2000 | Kuhns | |
| 6,052,959 A | * | 4/2000 | LaBrosse | 52/302.6 |

* cited by examiner

*Primary Examiner*—Carl D. Friedman
*Assistant Examiner*—Steve Varner
(74) *Attorney, Agent, or Firm*—McNees Wallace & Nurick LLC; Carmen Santa Maria

(57) ABSTRACT

The present invention is directed to a diverter and to a method that prevents rainwater from seeping behind siding or under roofing material, yet at the same time does not allow the buildup of debris creating a back up of water or allow the formation of ice dams to create a back up of water. In one form the present invention is installed to a vertical wall at a juncture between the vertical wall and an edge of a sloped roof to prevent water flowing along a roof-wall juncture from seeping behind siding located on the vertical wall and shingles located on the sloped roof. The invention comprises a back wall, a top wall, a bottom wall, a first side wall, and a second side wall in the form of an open sided box. The open side extends outwardly from the vertical wall to serve as an exit, with the top wall having at least one access opening. This access opening is positioned such that water flowing along a roof wall juncture enters the access opening preventing the water from seeping behind the vertical wall and shingles located on the sloped roof. Optionally, the water collected is transported away from the building by a rain gutter which terminates within the diverter. In a different embodiment the diverter has at least one drip edge.

20 Claims, 7 Drawing Sheets

RAINWATER DIVERTER

This application claims the benefit of U.S. Provisional Application No. 60/196,701 filed Apr. 13, 2000 entitled Rainwater Diverter, hereby incorporated by reference into this Application.

FIELD OF THE INVENTION

The present invention relates generally to siding placed on a house, and more specifically to diverting rainwater from the juncture of a sloped roof and vertical wall siding.

BACKGROUND OF THE INVENTION

Siding is often used to protect the outside of the house. Such siding is generally made of aluminum or vinyl material and is attached along the outside face of a house. At the juncture of a sloped roof where it abuts a portion of a vertical wall, there is ordinarily a flashing used to cover the juncture to prevent water from leaking down through the juncture where the vertical wall meets the sloped roof.

The flashing generally comprises a wall flange which is mostly hidden from view beneath the siding and a roof flange which is mostly hidden from view by the roof covering. The two flanges, generally made of a single strip of waterproof material and bent along its length at approximately a right angle, are purposely made leak proof to prevent rainwater from getting into the line of abutment between the roof and wall. Often referred to as a step gable or wall flashing, such flashing generally comprises a series of flashing members arranged in stepped manner, each lower member inserted an effective distance beneath the next higher member in the same manner that roofing shingles or tiles are positioned. This provides cascading of the water as it flows from one overlapping portion, in turn, to the next lower, overlapped portion.

The overlapping flashing arrangement terminates at the roof edge. Water can flow behind the vertical wall abutting this termination point unless the water is diverted away. At the point where the vertical wall and the edge of the sloped roof coincide, the flashing abuts the siding on the vertical wall. Additional steps are required at this point to prevent water from running off the flashing, seeping behind the siding and causing damage to the underlying structure.

One method of preventing water from seeping behind the siding is to apply sealing material for example, roof cement or caulking to the flashing and to the siding. The problem with such a method is that due to shrinkage of the sealing material over time, thermal expansion and contraction of the dissimilar materials, and weathering, the seal fails and water seeps behind the siding.

Siding is often capped with a J channel where the vertical wall meets the sloping roof in order to give a more finished appearance. Typically, the J channel is extended past the edge of the roof in an attempt to channel water into a rain gutter. As rain travels down the vertical face of the siding there is a tendency for the rain to flow along the J channel and thereby seep behind the siding as the water exits the J channel into the rain gutter. Continued rain and moisture may deteriorate the wood of the frame and surrounding area. Water may also be able to flow into insulating material located behind the siding and cause the insulating material to become filled with water. Any water retained in the insulating material may cause additional moisture damage to the house itself.

Various diverter designs have been developed in an attempt to avoid this problem and to direct water away from the vertical wall which extends beyond the eve of the sloping roof. In one form, shown in FIG. 1, the diverter comprises a triangular portion 100 as an integral part of the flashing, with the upper corner of the triangular portion being essentially contiguous with the intersection of the vertical wall flange 110 and the sloping roof flange 120. The diverter lies in a plane which is at an obtuse angle with both the plane of the vertical wall flange and the sloping roof flange, when viewed from its top side, and the two lower corners extend at the lower edges of the vertical wall flange 110 and the sloping roof flange 120. This triangular portion 100 serves to deflect rainwater away from the vertical wall siding 130.

Shown in FIG. 2 is another attempt at diverting rainwater, consisting of two flanges at right angles to each other, with an integral triangular portion 200, the upper comer of the triangular portion is contiguous with a bilateral line of symmetry formed by the two flanges. The diverter part lies in a plane which is at an obtuse angle with both the planes of the symmetrically positioned flanges, and the two lower corners extend symmetrically to the lower edges of the symmetrical flanges. The flange members are positioned behind the diverter, out of sight when installed on the roof 230. This triangular portion also serves to deflect rainwater away from the vertical wall siding 220.

Still another previous attempt at flashing designed for diverting water, shown in FIGS. 3*a* and 3*b*, has a vertical planar section 310 and a transverse planar section 320, and is generally L-shaped. A generally L -shaped step, or deflector 300, is formed on the lower end of the flashing. The vertical planar section 310 is positioned under the siding material 330 and flush with the vertical wall at the juncture between the vertical wall and the edge of the sloped roof. The transverse planar section 320 is positioned under the roofing material 340 and flush with the sloped roof. The deflector wraps around the siding, which abuts the flashing. The flashing cooperates with the siding material and diverts water flowing down the juncture of the vertical wall and roof away from the siding.

The problem with these prior art designs is their propensity to create ice dams as the rainwater strikes the triangular or deflecting portion backing up under the roofing material and siding, causing additional damage. Furthermore, as leaves and other debris are carried by the water against the deflecting portion, the debris will eventually build up, creating a dam, thereby allowing water to back up under the roofing material and siding.

What is needed is a diverter that will prevent rainwater from seeping behind siding or under roofing material, and at the same time not allow the buildup of debris or the formation of ice dams.

SUMMARY OF THE INVENTION

The present invention is directed to a diverter that prevents rainwater from seeping behind siding or under roofing material, yet at the same time does not allow the buildup of debris creating a back up of water or allow the formation of ice dams to create a back up of water.

In one embodiment, the present invention is installed to the vertical wall of a building at a juncture between the vertical wall and an edge of a sloped roof to prevent water flowing along a roof-wall juncture from seeping behind siding located on the vertical wall where shingles located on the edge of the sloped roof abut the vertical wall. The invention comprises a back wall, a top wall, a bottom wall, a first side wall, and a second side wall in the form of an open sided box. The open side extends outwardly from the vertical wall and serves as an exit, with the top wall including at least one access opening. This access opening is positioned such that water flowing along a roof wall juncture enters the access opening and leaves the diverter through the exit to be collected by a rain gutter and diverted away from the building.

In a different embodiment there is at least one drip edge. One advantage of a drip edge is that with the use of a drip edge, architectural designs calling for the absence of a rain gutter may still be protected. Water flowing along the roof wall juncture will flow into the diverter and then overflow the diverter over the drip edge to continue down the vertical wall without seeping behind the siding.

Another advantage of the present invention is that water entering into the access opening is prevented from seeping behind the siding or roof shingles. The back wall physically separates the water from siding and shingles, allowing the water to flow into a gutter and thereby be diverted.

Yet another advantage of the present invention is that by diverting the water into a gutter positioned within the device, if ice should form, the ice will be contained within the device, thus preventing water and ice from backing up behind the siding or under the shingles.

Still another advantage of the present invention is that water would flow through any buildup of leaves or debris and continue to enter into the access opening to be diverted away from siding or shingles. Any buildup of leaves or debris would not serve to back up flowing water under siding or shingles.

Other features and advantages of the present invention will be apparent from the following more detailed description of the preferred embodiment, taken in conjunction with the accompanying figures which illustrate, by way of example, the principles of the invention.

DETAILED DESCRIPTION OF THE PREFERRED EMBODIMENTS

Figure 1:
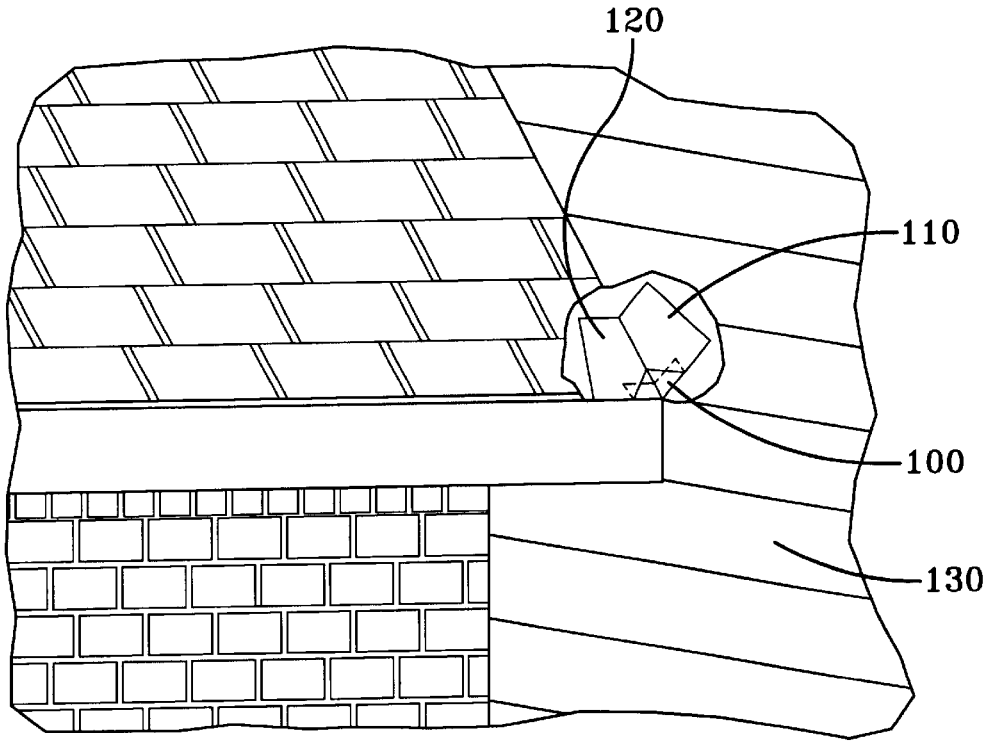
FIG-1 PRIOR ART
FIG. 1 is a representation of one form of an existing diverter design positioned at the roof-wall juncture.
Figure 2:
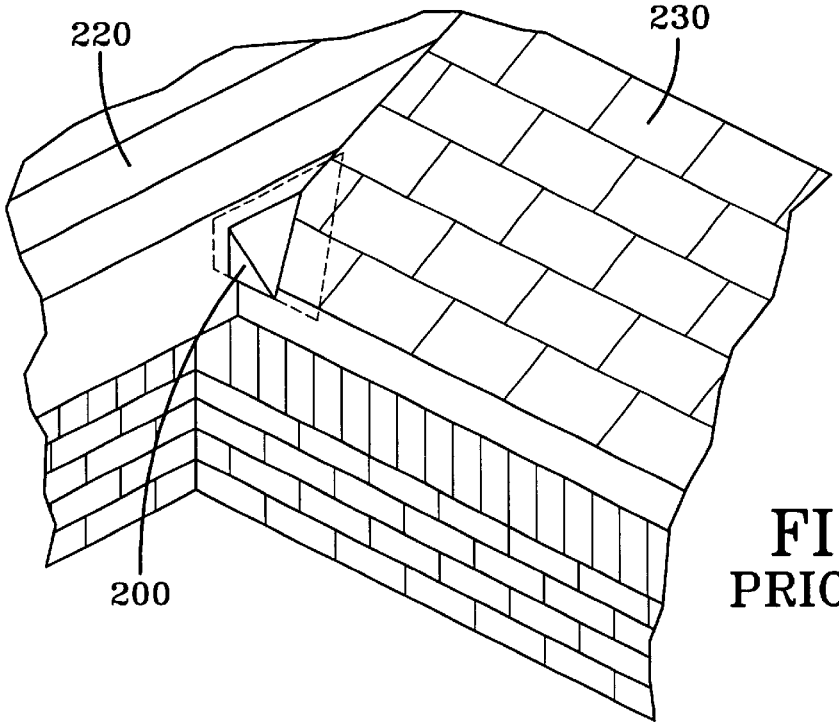
FIG-2 PRIOR ART
FIG. 2 is a representation of another form of an existing diverter design positioned at the roof-wall juncture.
Figure 3A:
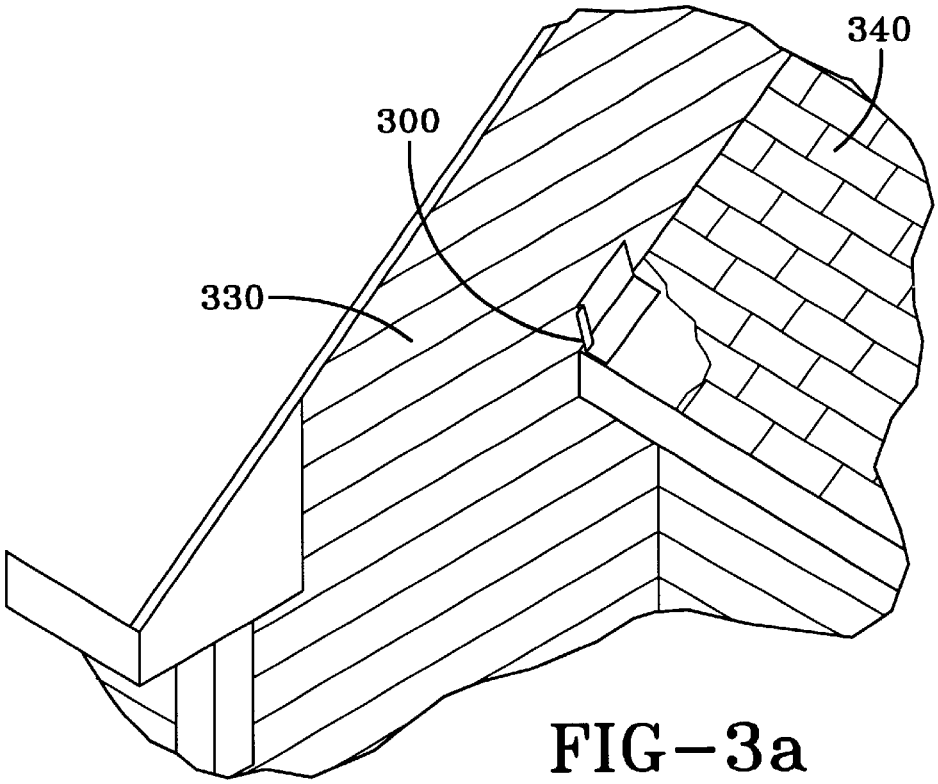
FIG-3a PRIOR ART
FIG. 3*a* is a representation of yet another form of an existing diverter design positioned at the roof-wall juncture.
Figure 3B:
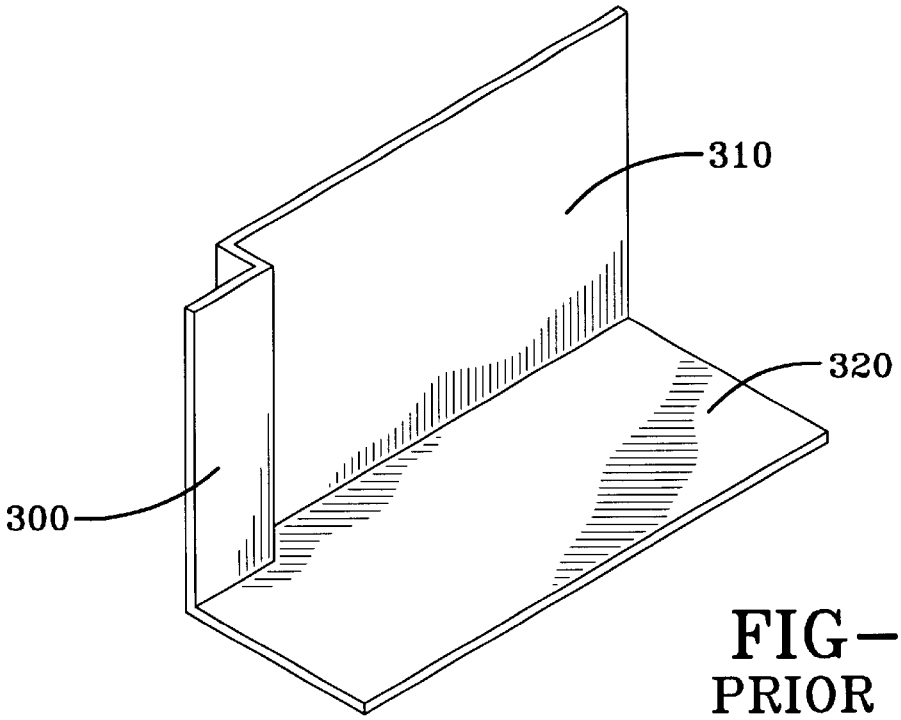
FIG-3b PRIOR ART
FIG. 3*b* is an enlarged view of the diverter design of FIG. 3*a*.
Figure 4:
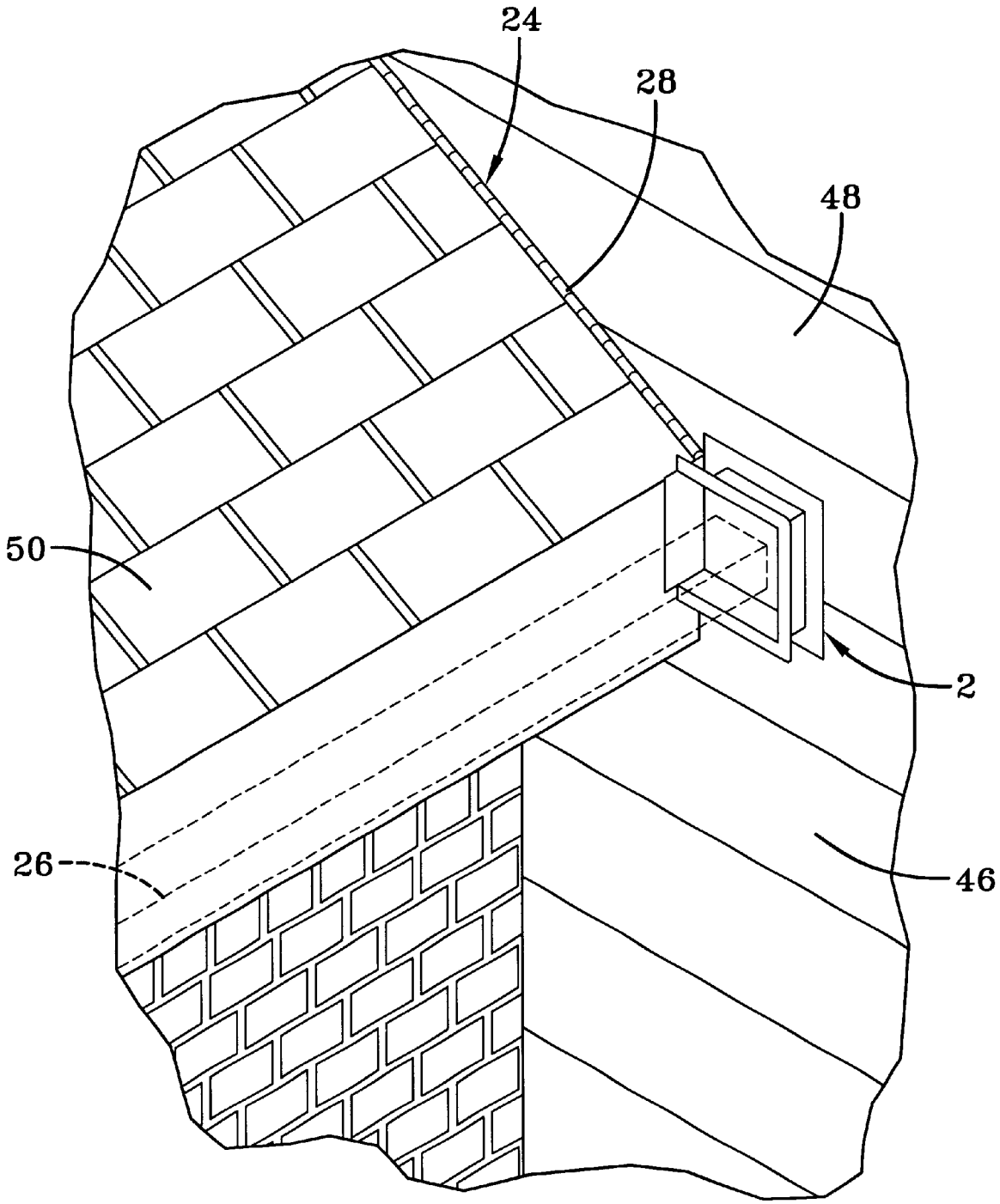
FIG. 4 is a representation of a form of the present diverter design positioned at the roof-wall juncture.
Figure 5:
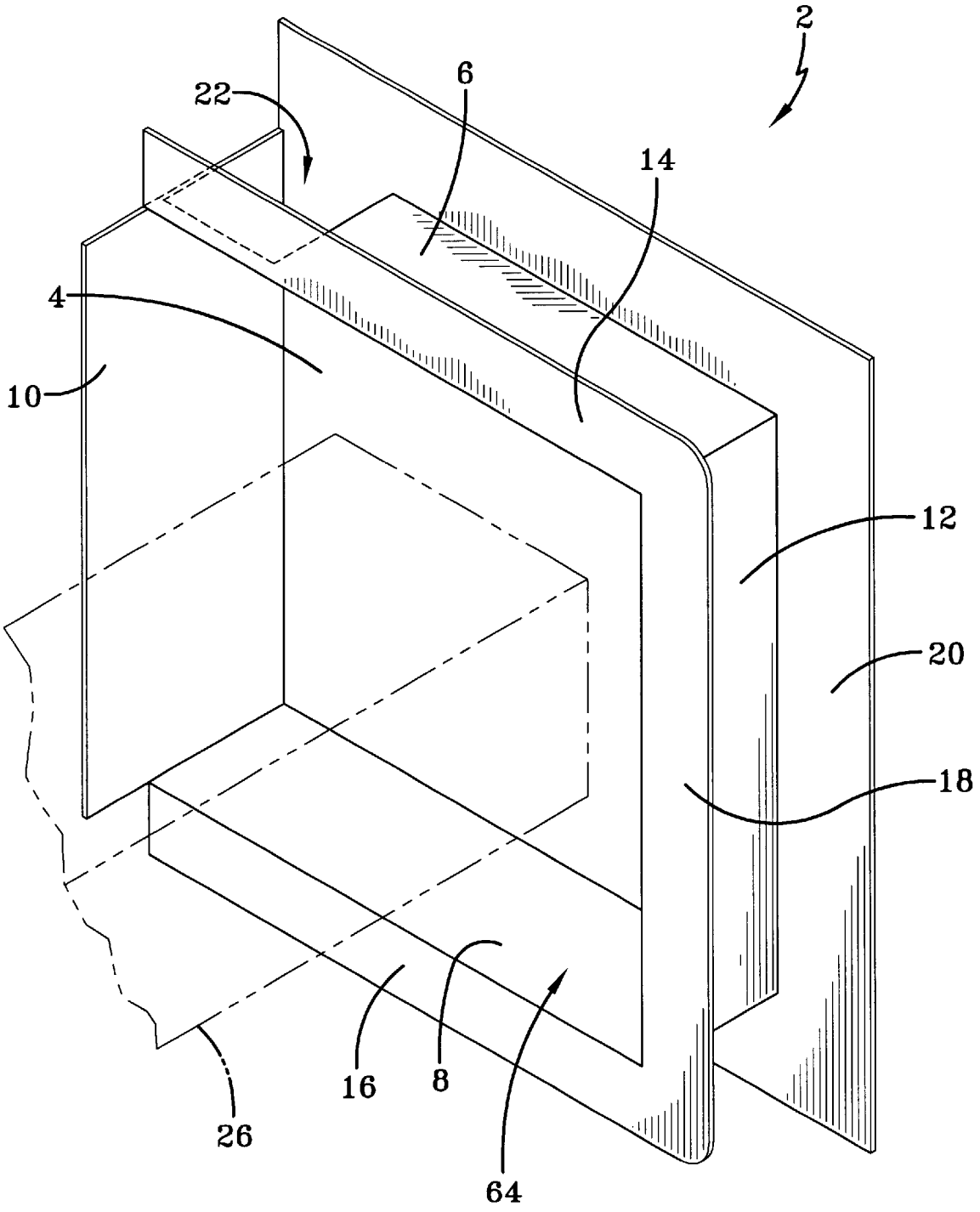
FIG. 5 is a frontal view of one form of the improved rainwater diverter of the present invention for use with a left to right downward sloped roof.

Referring now to the Figures, where like parts have the same numbers, in accordance with a preferred embodiment of the invention, there is shown in FIG. 4 an improved rainwater diverter 2 for installation to a building in a vertical wall 48 at the juncture between the vertical wall 48 and an edge of a sloped roof 50. Referring to FIG. 5, the diverter 2 comprises a back wall 4, a top wall 6 , a bottom wall 8, a water striking side wall 10, and a second side wall 12 in the form of an open sided box with the open side extending outwardly from the vertical wall in a plane substantially parallel to the plane of the vertical wall. The open side 62 serves as the exit 64 for collected water. The diverter 2 of the present invention may be utilized with any building material for example, vinyl siding, aluminum siding, wood siding, and masonry exterior finishes for example, stucco or brick.

The diverter 2 is manufactured from any liquid impervious material such as, for example vinyl, PVC, polystyrene, rubber, aluminum, stainless steel and the like. While optional, it is desirable that the diverter 2 be rigid or semi-rigid to enhance stability and inhibit straining of the device. An injection molded manufacturing process is preferred, to reduce manufacturing costs.

As shown in FIG. 5, the top wall 6, bottom wall 8, water striking side wall 10, and second side wall 12 have a cross section that forms a rectangle, about four inches to about eight inches, preferably about six inches in height and about five inches to about nine inches, preferably about seven inches in width. This size will accommodate both five inch or six inch gutters, standard in the industry, however, it should be appreciated the invention dimensions can be varied to accommodate any size gutter. A top wall drip edge 14, bottom wall drip edge 16, and second side wall drip edge 18 each makes an approximate right angle with its associated wall, extending outward about one-half inch to about 1¼ inch, preferably about three quarter inch.

A self flashing flange 20 is in an approximate planar relationship with the back wall 4, and extends outwards an effective distance to be covered by vertical wall material, for example, the siding or masonry 46, preferably extending about one inch to about two inches, most preferably about 1½ inches from all sides except that of the water striking side wall 10. The water striking side wall 10 has no flange.

Preferably, second side wall 12, top wall 6 and bottom wall 8 are about three quarter inch to about 1½ inch, preferably about one inch in width, thereby causing the back wall 4 to be recessed about three quarter inch to about 1½ inch, preferably about one inch from the plane determined by the top drip edge 14, bottom drip edge 16 and side drip edge 18. The back wall 4, after installation, lies in a plane substantially parallel to the plane of the vertical wall 48 of the structure. The back wall 4 lies at approximately a right angle to the top wall 6, bottom wall 8, water striking side wall 10 and second side wall 12.

The top wall 6 has at least one access opening 22 of about one-half inch to about two inches, preferably about 1½ inches in length, extending from approximately the self flashing flange 20 to the top drip edge 14 in width. It should be appreciated these dimensions are exemplar only, the actual size of the opening is any effective size that will allow substantially all the water to enter. The access opening 22 is positioned such that one end communicates with the water striking side wall 10. Optionally, a second access opening 22 of substantially the same dimensions is positioned such that one end communicates with the second side wall 12 to prevent water from flowing over the second side wall 12/top wall 6 interface and seeping behind the siding 46. An alternative option is to replace the second access opening 22 with a tab (not shown) that extends from the top wall 6 in a plane substantially the same as the plane of the second side wall 12 an effective distance to physically restrict water flow over the second side wall 12/top wall 6 interface, for example, about ½ to about 1 inch.

The water striking side wall 10 extends an effective distance beyond the plane created by the drip edges 14, 16 18 to inhibit splashing outside the diverter. For example, the water striking side wall 10 extends about one-half inch to about 1½ inches, preferably about one inch beyond the plane determined by the top drip edge 14, bottom drip edge 16 and side drip edge 18, extending substantially parallel to and behind the rain gutter 26.

When installed, the water striking side wall 10 is the side closest to the sloped roof. Therefore, the diverter 2 used in conjunction with a roof sloping downward from left to right would be a mirror image of a diverter 2 used in conjunction with a roof sloping downward from right to left. To avoid the installer having to stock "right hand" and "left hand" diverters 2, there are provided trim tabs, "punch out" access openings 22, and self flashing flanges 20 on all sides, as shown in FIGS. 6 and 7.

Figure 6:
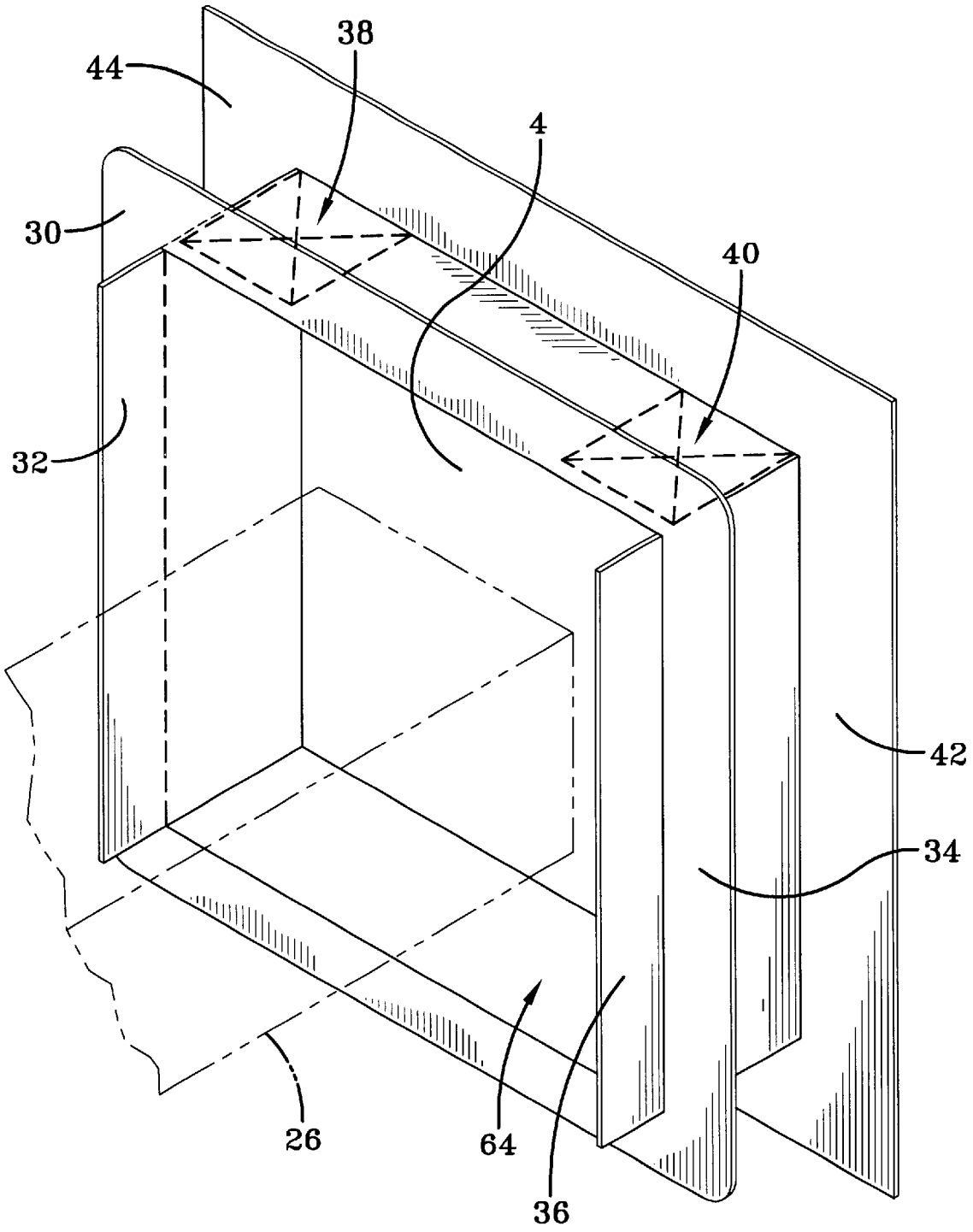
FIG. 6 is a frontal view of one form of the improved rainwater diverter of the present invention before removal of the trim tabs, punch out access opening and self flashing flange.
Figure 7:
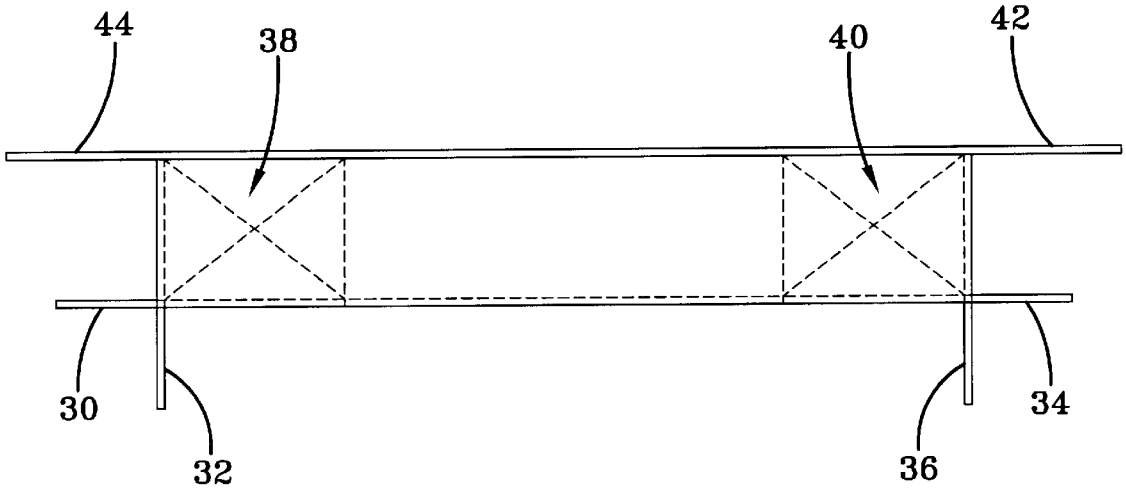
FIG. 7 is a top view of one form of the improved rainwater diverter of the present invention before removal of the trim tabs, punch out access opening and self flashing flange.

Shown in FIGS. 6 and 7 is a left side trim tab 30, a left front trim tab 32, a right side trim tab 34, a right front trim tab 36, a left punch out access opening 38, a right punch out access opening 40, a right side self flashing flange 42 and left side self flashing flange 44.

The front trim tab 32, 36 and side trim tab 30, 34 lie in a plane substantially 90 degrees to one another. The front trim tab 32, 36 is an extension of the side wall at the point it extends beyond the plane determined by the top drip edge 14, bottom drip edge 16 and side drip edge 18. The side trim tab 30, 34 lies in substantially the same plane as the top drip edge 14 and bottom drip edge 16.

For use with a roof sloping downward from left to right, the left side trim tab 30, right front trim tab 36, left punch out access opening 38 and left side self flashing flange 20 are removed using for example, a shear, a scissors, a knife, or a saw. For use with a roof sloping downward from right to left, the right side trim tab 34, left front trim tab 32, right punch out access opening 40 and right side self flashing flange 42 are removed. Optionally, as described above, a second access opening (38 or 40, as appropriate) may be removed. In this manner, a water striking side wall 10, a side wall drip edge 18, an access opening 22 and self flashing flanges 20 appropriate to either a left to right downward sloping roof or a right to left downward sloping roof can be fabricated from a single stock item. (FIG. 5).

The improved rainwater diverter 2 is positioned as follows: After determining the roof slope, the installer removes the appropriate (FIG. 6) front trim tab 32, 36, side trim tab 30, 34, punch out access opening 38, 40 and side self flashing flange 42, 44 as described above. Siding, and if necessary, sheathing is removed from the vertical wall in a manner such that the diverter 2 is recessed within the vertical wall 48 (FIG. 4). The diverter 2 is positioned where the edge of the sloped roof 50 meets the vertical wall 48 such that the juncture of the sloped roof—vertical wall interface 24 is substantially contiguous to the access opening 22 (FIG. 5). If J channel 28 is to be used, the J channel 28 terminates substantially at the access opening 22 (FIG. 4). The top edge of the water striking side wall 10 should rest substantially against the edge of the sloped roof (FIG. 4). Siding is replaced as necessary such that it overlaps all self flashing flanges 20 and preferably abuts the top, bottom and second side wall 6, 8, 12, respectively, remaining behind the drip edges 14, 16, 18. An optional rain gutter 26 installed along the edge of the sloping roof 50 (FIG. 4) terminates within the exit, for example, the recessed portion of the diverter 2 such that the end of the gutter 26 contacts or is proximate to the back wall 4.

As water flows down the vertical wall—sloping roof line interface 24 and/or the J channel 28, it flows directly into the access opening(s) 22 to be removed through the exit 64 by the rain gutter 26 rather than striking an abutted edge of siding. Because the siding overlaps the self flashing flanges 20, water traveling down the vertical wall 48 cannot seep the behind the diverter 2. The extended water striking side wall 10 and drip edges 14, 16, 18 also direct water away from seeping under the siding and shingles. The drip edges 14, 16, 18 serve, in essence as "built in" J channels.

Figure 8:
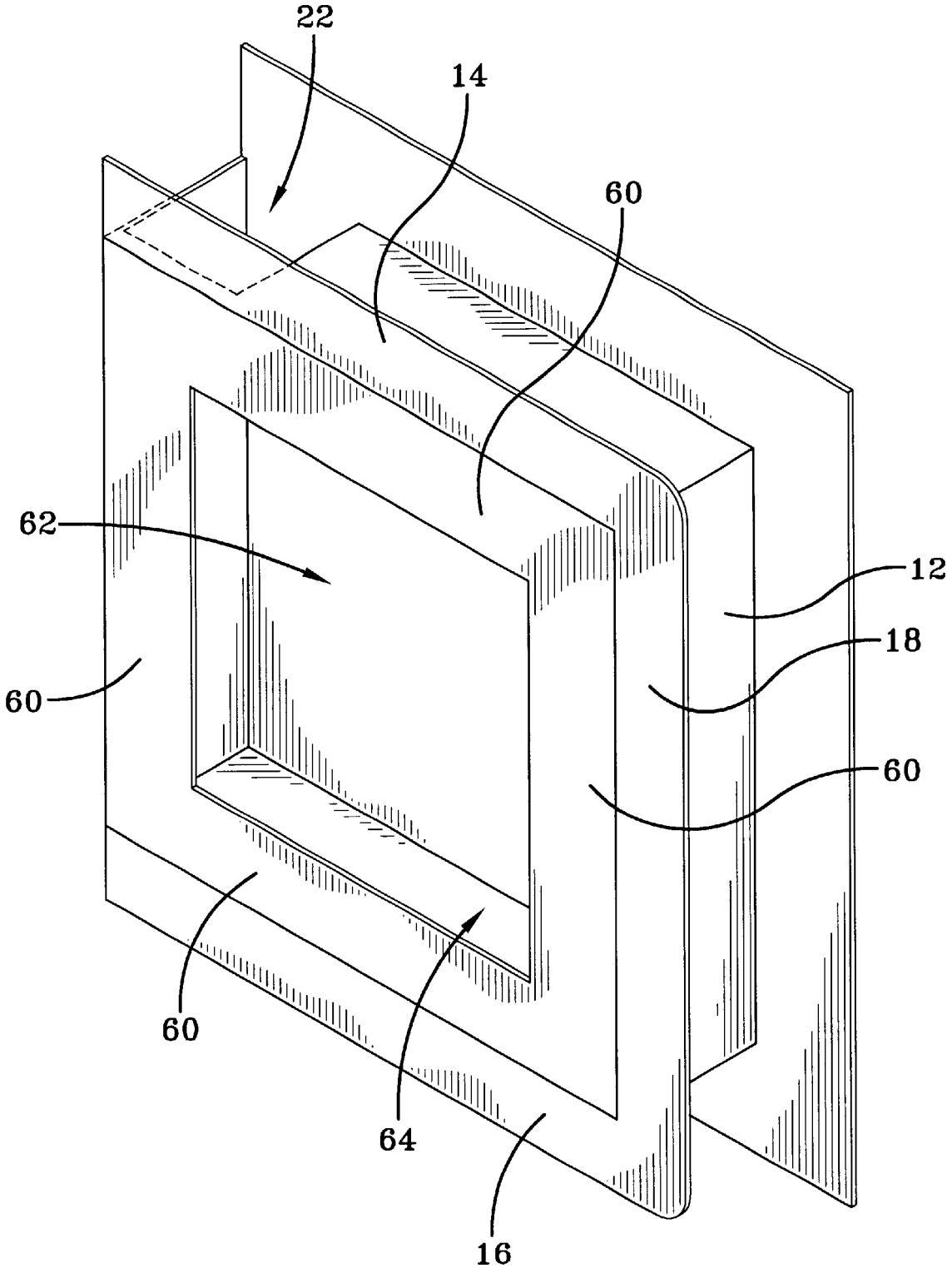
FIG. 8 is a frontal view of an alternate form of the improved rainwater diverter of the present invention for use with a left to right downward sloped roof.

In another form of the present invention, shown in FIG. 8, rather than a water striking side wall, a lip 60 extends inward lying in substantially the plane determined by the top drip edge 14, bottom drip edge 16 and side drip edge 18 about ½ inch to about 2 inches, preferably about 1 inch, completely encasing the open side 62. In this manner, the lip will prevent water entering through the access opening 22 from splashing in much the same manner as the water striking side wall 10. Therefore, this embodiment would require trimming of only the appropriate side flange 42, 44 and punch out access opening(s) 38, 40. Side trim tabs 30, 34 or front trim tabs 32, 36 (FIG. 6) would not need to be manufactured into the diverter.

Although the present invention has been described in connection with specific examples and embodiments, those skilled in the art will recognize that the present invention is capable of other variations and modifications within its scope. For example, the drip edges may be omitted.

These examples and embodiments are intended as typical of, rather than in any way limiting on, the scope of the present invention as presented in the appended claims.

What is claimed is:

1. A rainwater diverter for receiving a rain gutter comprising:

a back wall, a top wall, a bottom wall, a first side wall, and a second side wall in the form of an open sided box;

a self-flashing flange in approximate planar relationship with the back wall and extending outward from the back wall;

wherein the diverter is adapted for installation to a vertical wall of a building at a juncture between the vertical wall and an edge of a sloped roof by attachment of the self-flashing flange to the vertical wall of the building;

the open side extends outwardly from the vertical wall of the building to form an exit; and, the top wall includes at least one access opening positioned such that water flowing along the roof-wall juncture enters into at least one access opening, preventing water from seeping behind the vertical wall of the building and shingles located on the sloped roof, and is diverted through the exit.

2. The rainwater diverter of claim 1 further comprising a drip edge extending outward at about a right angle from a diverter wall, the diverter wall selected from at least one of the group consisting essentially of the top wall, bottom wall, first side wall and second side wall.

3. The rainwater diverter of claim 2 wherein the drip edge lies in a plane substantially parallel to a plane that includes the vertical wall.

4. The rainwater diverter of claim 2 wherein a lip extends inwardly about ½ inch to about 2 inches into an open side.

5. The rainwater diverter of claim 4 wherein the lip lies in a plane substantially parallel to a plane that includes the drip edge.

6. The rainwater diverter of claim 2 wherein the first side wall is a water striking side wall extending an effective distance beyond a plane that includes the drip edges to inhibit splashing outside the diverter.

7. The rainwater diverter of claim 6 wherein the water striking side wall extends about one-half inch to about 1½ inches beyond the plane determined by the top drip edge, bottom drip edge and side drip edge, and extends substantially parallel to and behind a rain gutter.

8. The rainwater diverter of claim 1 wherein at least one access opening is positioned to receive a J channel.

9. The rainwater diverter of claim 1 wherein the first side wall, second side wall, top wall and bottom wall are about three quarter inch to about 1½ inch in width.

10. The rainwater diverter of claim 1 further including a self flashing flange extending outwardly from the back wall an effective distance to be covered by vertical wall material.

11. The rainwater diverter of claim 10 wherein the self flashing flange lies in substantially the same plane as a plane that includes the back wall.

12. The rainwater diverter of claim 10 wherein the self flashing flange extends outwardly from the back wall about one inch to about two inches.

13. The rainwater diverter of claim 1 wherein the diverter is manufactured from any liquid impervious material.

14. The rainwater diverter of claim 13 wherein the liquid impervious material is selected from the group consisting essentially of vinyl, PVC, polystyrene, rubber, aluminum and stainless steel.

15. A rainwater diverter for installation to a vertical wall of a building at a juncture between the vertical wall and an edge of a sloped roof comprising:

a back wall, a top wall, a bottom wall, a first side wall, and a second side wall in the form of an open sided box; wherein, the top wall and bottom wall each terminate in a drip edge, the drip edge extending outwardly;

the first and second side wall each extend beyond a plane created by the drip edges, forming a first and second front trim tab, respectively;

a first and second side trim tab each extend outwardly at about a 90 degree angle from the first and second front trim tab, respectively, the side trim tabs each lying substantially in the plane formed by the drip edges of the top wall and bottom wall;

a self flashing flange extends outwardly from the back wall an effective distance to be covered by vertical wall material;

an open side extends outwardly from the vertical wall; and at least one punch out access opening positioned in the top wall such that water flowing along the roof-wall juncture enters into at least one punched out access opening preventing the water from seeping behind the vertical wall and shingles located on the sloped roof.

16. The rainwater diverter of claim 15 wherein the drip edge lies in a plane substantially parallel to the plane that includes the vertical wall, and the self flashing flange lies in substantially the same plane as a plane that includes the back wall.

17. A method to protect vertical walls and shingles from water damage resulting from water seepage due to flow along a sloped roof-wall juncture located on the sloped roof comprising the steps of:

a) positioning a diverter at a juncture between the vertical wall and an edge of the sloped roof such that water flowing along the roof-wall juncture enters into the diverter; and b) recessing the diverter into the vertical wall.

18. The method of claim 17 further comprising the step of transporting the water away from the diverter through an exit.

19. The method of claim 17 wherein the diverter comprises:

a back wall, a top wall, a bottom wall, a first side wall, and a second side wall in the form of an open sided box; wherein, an open side extends outwardly from the vertical wall to serve as an exit; and the top wall has at least one access opening positioned such that water flowing along the roof-wall juncture enters into at least one access opening.

20. The rainwater diverter formed by the method of claim 16.

* * * * *